United States Patent [19]

Christian et al.

[11] Patent Number: 4,641,689

[45] Date of Patent: Feb. 10, 1987

[54] METHOD ARE EQUIPMENT FOR MAKING WIRE STRANDS

[75] Inventors: Philip Christian, Norton, near Doncaster; Alan I. Tawse, Hatfield, near Doncaster, both of England

[73] Assignee: Bridon plc, Doncaster, England

[21] Appl. No.: 640,686

[22] Filed: Aug. 13, 1984

[30] Foreign Application Priority Data

Aug. 19, 1983 [GB] United Kingdom ..... 8322441

[51] Int. Cl.[4] ..... B21F 7/00

[52] U.S. Cl. ..... 140/149

[58] Field of Search ..... 140/149, 115; 57/314, 57/10, 214, 217; 14/22

[56] References Cited

U.S. PATENT DOCUMENTS

| | | | |
|---|---|---|---|
| 1,157,500 | 10/1915 | Bräckerbohm | 57/10 |
| 1,990,514 | 2/1935 | Angell | 140/149 |
| 2,460,478 | 2/1949 | Warner | 57/10 |
| 2,790,299 | 4/1957 | Gillis et al. | 57/314 |
| 2,835,283 | 5/1958 | Thone et al. | 140/149 |
| 3,128,799 | 4/1964 | Kerr | 140/149 |
| 3,732,682 | 5/1973 | Crotty et al. | 57/314 |
| 3,847,190 | 11/1974 | Forester | 140/149 |
| 3,979,896 | 9/1976 | Klett et al. | 57/217 |
| 4,075,880 | 2/1978 | Copeland | 140/149 |
| 4,207,928 | 6/1980 | Pershin et al. | 140/149 |

FOREIGN PATENT DOCUMENTS

| | | | |
|---|---|---|---|
| 86633 | 6/1980 | Japan | 140/149 |

*Primary Examiner*—Lowell A. Larson

*Attorney, Agent, or Firm*—Trexler, Bushnell & Wolters, Ltd.

[57] ABSTRACT

Equipment for making a wire strand is characterised by the following features; an elongate track (12); a clamp (14) at one, leading end of the track rotatable about an axis parallel to the track; an anchor frame (15) at the other trailing end of the track having rotatable tensioning spaced anchorages (16) for wires (17) extending parallel to the track; a trolley (18) movable along the track (12) and carrying adjacent the leading end a rotatable closing die (19) having an aperture (20) of cross-section corresponding to the cross-section of the strand (11), and adjacent the trailing end a grouper plate (21) having spaced wire guide apertures (22) corresponding to the anchorages (16) on the anchor frame (15), there also being on the trolley (18) intermediate the closing die (19) and the grouper plate (21) a lay plate (23) having wire guide apertures (24) with spacings intermediate the spacing of the guide apertures (22) in the grouper plate (21) and the closeness in the closing die (19); a first drive arrangement (25) for moving the trolley (18) along the track (12) from the leading end to the trailing end; a second drive arrangement (26) for rotating the clamp (14) at the leading end of the track (12) with a predetermined relationship to movement of the trolley (18); removable supports (27) for the wires (17) at intervals between the trolley (18) and the anchor frame (15); and removable supports (28) for the strand (11) at intervals between the rotatable clamp (14) and the trolley (18).

8 Claims, 10 Drawing Figures

METHOD AND EQUIPMENT FOR MAKING WIRE STRANDS

This invention relates to a method and equipment for making wire strands, primarily for large static load bearing applications, e.g., for use on bridges, mast stays and for offshore mooring purposes. The invention enables very large strands to be manufactured without the limitations associated with conventional machinery and offers much greater versatility in its use and application.

One object of the invention is to provide for manufacture of strands with longer lays than has previously been possible.

Another object of the invention is to enable strands of large diameter to be manufactured.

A further object of the invention is to enable large diameter wires to be stranded together without introducing the high bending stresses involved with conventional bobbin-type stranding machinery.

Another object of the invention is to permit stranding together of a larger number of wires in one operation than conventional equipment allows.

A further object of the invention is to enable the making of a wire strand with less complexity and at a lower cost than conventional manufacture allows.

Another object of the invention is to provide portable equipment for making a wire strand adjacent to a site, e.g. a bridge where the strand is to be employed.

According to one aspect of the present invention, a method of making a wire strand comprises: assembling a multiplicity of wires side-by-side; securing all the wires together at one, leading end; securing all the wires separately at the other, trailing end, spaced apart and freely rotatable; applying tension to all the wires; guiding the wires intermediate the ends into a closed array; moving the aforesaid guiding progressively from the leading end to the trailing end; rotating the leading end progressively as the aforesaid guiding moves progressively; releasing the trailing ends of the wires and the tension applied thereto; and securing all the wires together at the trailing end.

The combination of tension in the wires and rotation of the leading end of the closed array and rotation of the trailing ends of the wires results in a helical formation in the wires to maintain a lay derived from the rotation of the leading end as the guiding of the wires into a closed array moves progressively along the assembly of wires, but freedom for the trailing ends of the wires to rotate will ensure that no torsional stresses are induced in the wires individually.

For very long lay strands, the individual wires may be advantageously manufactured in a straight condition or straightened before the above stranding operation.

The leading ends of the assembly of wires and (subsequently) the trailing ends of the closed array of wires may be secured together by brazing, clamping or other suitable means.

The completed strand may be enclosed in a sheath, which may be applied by extrusion, or which may be in the form of a tube into which the strand is inserted, e.g., by pulling, and which is filled with a blocking medium, e.g., grease, synthetic resin, or grout.

According to another aspect of the invention, equipment for making a wire strand comprises: an elongate track; a clamp at one, leading end of the track rotatable about an axis parallel to the track; an anchor frame at the other, trailing end of the track having freely rotatable tensioning spaced anchorages for wires extending parallel to the track; a trolley movable along the track and carrying adjacent the leading end a rotatable closing die having an aperture of cross-section corresponding to the corss-section of the strand, and adjacent the trailing end a grouper plate having spaced wire guide apertures corresponding to the anchorages on the anchor frame, there also being on the trolley intermediate the closing die and the grouper plate a lay plate having wire guide apertures with spacings intermediate the spacing of the guide apertures in the grouper plate and the closeness in the closing die; first drive means for moving the trolley along the track from the leading end to the trailing end; second drive means for rotating the clamp at the leading end of the track with a predetermined relationship to movement of the trolley; removable supports for the wires at intervals between the trolley and the anchor frame; and removable supports for the strand at intervals between the rotatable clamp and the trolley.

As the strand is formed by movement of the trolley along the track, the removable wire supports are removed in succession and the removable strand supports are inserted in succession. Each removable wire support may consist of a collapsible frame with uprights and withdrawable transverse rods, while each removable strand support may consist of a pillar with a base for engaging the track and a part-cylindrical cup, and to prevent the strand deforming due to its rotation in this cup a wrapping of tape (e.g., nylon reinforced adhesive tape) is preferably applied round the strand.

The anchor frame may consist of an apertured plate between uprights with baseplates, each aperture being provided with a screw-adjustable guide tube and a tensioning anchoring device, such as a compression spring between the guide tube and a thrust bearing which has a thrust washer brazed to the wire to be anchored and tensioned. Alternatively, each tensioning device may be a pneumatic or hydraulic cylinder with a clamp or wedge-type grip for applying the tension to the wire.

The trolley may consist of a base frame with longitudinal and transverse members, with the latter carrying the grouper and lay plates and the rotatable die on a bracket, and with supporting wheels and guiding wheels for engaging the track. The second drive means (for rotating the clamp) may be a motor at the leading end of the track, with gearing for rotating the clamp; and the first drive means (for moving the trolley) may be gearing extending along the track from the motor and engaging the trolley, or it may be a winch at the trailing end of the track.

Adjacent to the strand formingtrack, another track may be provided with restraints for holding a tube, which may be of plastics and into which a completed strand can be pulled by a rope from a pulling device attached to a pulling eye secured to one end of the strand.

It will be evident that a large number of the components of equipment according to the invention are inherently portable (i.e., the trolley and the removable wire and strand supports). Therefore, in accordance with a further aspect of the invention, the track is formed of a plurality of modular units, and the rotatable clamp and the anchor frame are each adapted to be secured to respective end units of the track. It follows that any required length of strand can be made using a track of corresponding length made up by an appropriate number of track units.

According to yet another aspect of the invention, a strand is formed by any the method and/or equipment in accordance with the invention, but more particularly a long lay wire strand is protected by a plastics sheath in the form of a close fitting tube and filled with a blocking medium.

The method and equipment are capable of being adapted for multi-operation, stranding, e.g., for forming multiple-layer cross-laid strands in which successive concentric layers of wires are applied to a core strand already manufactured in a preceding operation. For this purpose the core strand is tensioned and the complete length of core strand rotates, and additional drive means incorporating tensioning means may be required at the trailing end of the track for rotating that end of a core strand while under tension, in synchronisation with the clamp at the leading end of the track, in order to prevent any loss of turn over a long length of core strand.

The method and equipment may be used to manufacture strands from wires of metal or of non-metallic materials, of solid circular cross-section, or tubular, or of non-circular cross-section, e.g. interlocking shapes. For this latter purpose the individual wires may be advantageously pre-twisted to avoid problems with residual torque in the strand. The pretwisting operation may be carried out either during or prior to the introduction of the wires to the equipment. The degree of pretwist will preferably be controlled to correspond with the lay of the particular wires in the strand, i.e. so as to impart one full (360°) twist to the length of wire required for each lay of the strand.

Methods and equipment in accordance with the invention, and wire strand made thereby will now be described with reference to the accompanying drawings, showing embodiments of equipment, by way of example only, and in which.

Figure 1:
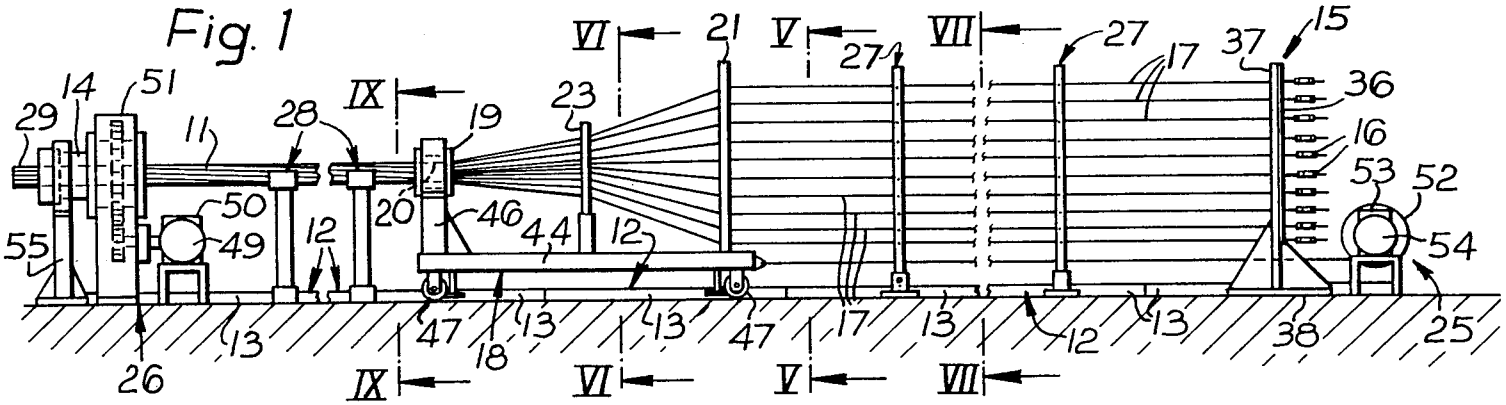
FIG. 1 is a diagrammatic side elevation of equipment in accordance with the invention.
Figure 3:
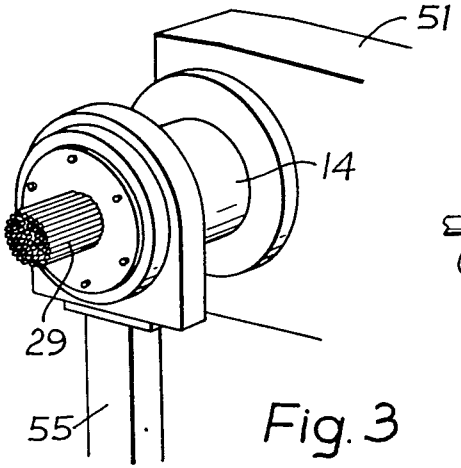
FIG. 3 is a fragmentary perspective view of the left hand end of the equipment to a larger scale.
Figure 2:
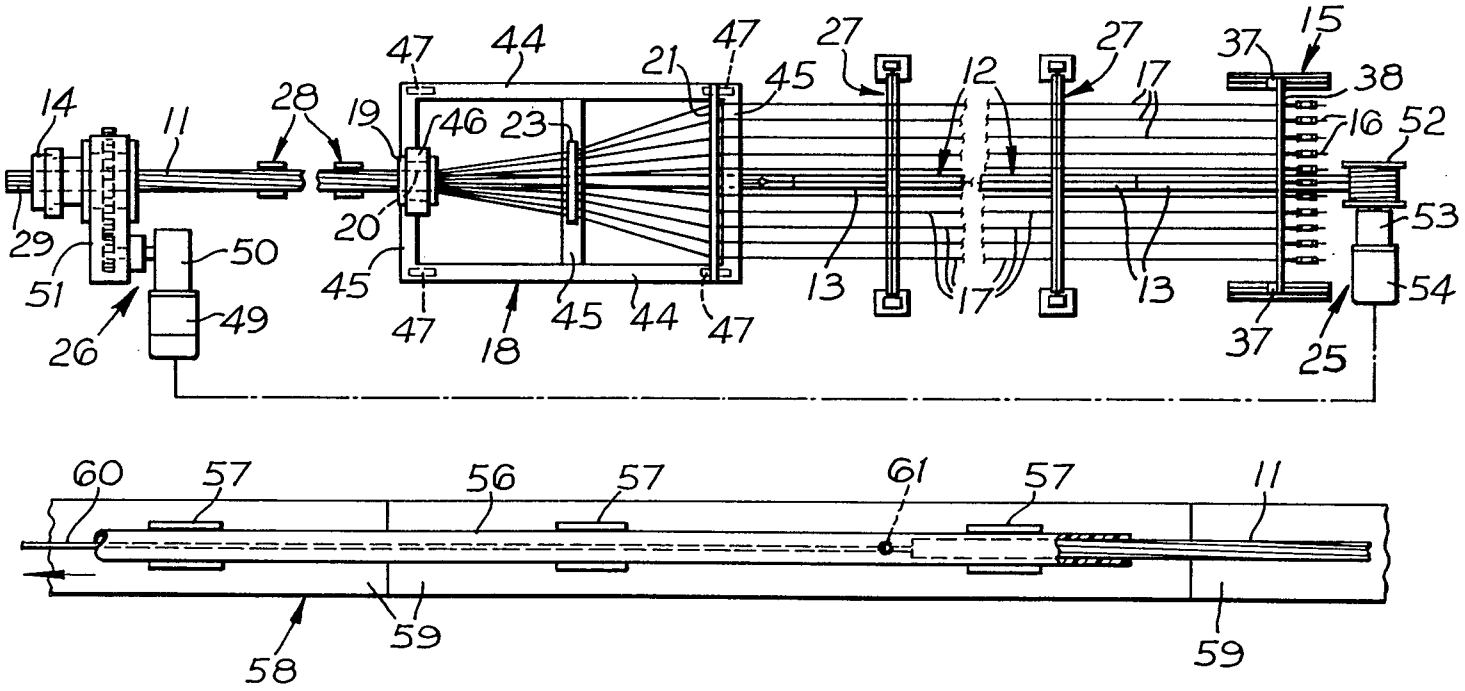
FIG. 2 is a diagrammatic plan of the equipment of FIG. 1 and shows additional equipment for carrying out an additional method step.

The equipment for making a wire strand 11 shown in FIGS. 1 and 2 comprises: an elongate track 12 (which is formed of a plurality of modular units 13); a clamp 14 (see also FIG. 3) at one leading end of the track rotatable about an axis parallel to the track; an anchor frame 15 at the other, trailing end of the track 12 having freely rotatable tensioning spaced anchorages 16 (see also FIG. 4) for wires 17 extending parallel to the track; a trolley 18 movable along the track and carrying adjacent the leading end a rotatable closing die 19 having an aperture 20 of cross-section corresponding to the cross-section of the strand 11, and adjacent the trailing end a grouper plate 21 (see also FIG. 5) having spaced wire guide apertures 22 corresponding to the anchorages 16 on the anchor frame 15, there also being on the trolley 18 intermediate the closing die 19 and the grouper plate 21 a lay plate 23 (see also FIG. 6) having wire guide apertures 24 intermediate the spacing of the guide apertures 22 in the grouper plate 21 and the closeness in the closing die 19; first drive means 25 for moving the trolley 18 along the track 12 from the leading end to the trailing end (and, in reverse, back again after a stranding operation); second drive means 26 for rotating the clamp 14 with a predetermined relationship to movement of the trolley 18; removable supports 27 (see also FIGS. 7 and 8) for the wires 17 at intervals between the trolley and the anchor frame 15; and removable supports 28 (see also FIG. 9) for the strand 11 at intervals between the rotatable clamp 14 and the trolley 18.

The method of operation, in accordance with the invention, comprises: assembling the multiplicity of wires 17 side-by-side; securing all the wires together at the leading end 29 (as by brazing); securing all the wires separately at the trailing end in the anchorages 16, spaced apart, freely rotatable and tensioned (as will be described in more detail presently with reference to FIG. 4); guiding the wires 17 intermediate the ends into a closed array, by means of the closing die 19 and lay plate 23 on the trolley 18; moving the aforesaid guiding progressively from the leading end to the trailing end, by the first drive means 25 moving the trolley 18 in that direction; rotating the leading end 29 progressively, by means of the second drive means 26 and the rotatable clamp 14, as the aforesaid guiding moves progressively; releasing the trailing ends of the wires 17 from the anchorages 16 and, therefore, also releasing the tension applied thereo; as by cutting the wires 17 at the leading side of the anchor frame 13 or by removing the washers 43 from the ends of the wires; and securing all the wires together at the trailing end 30, FIG. 10 only (as by brazing).

Figure 7:
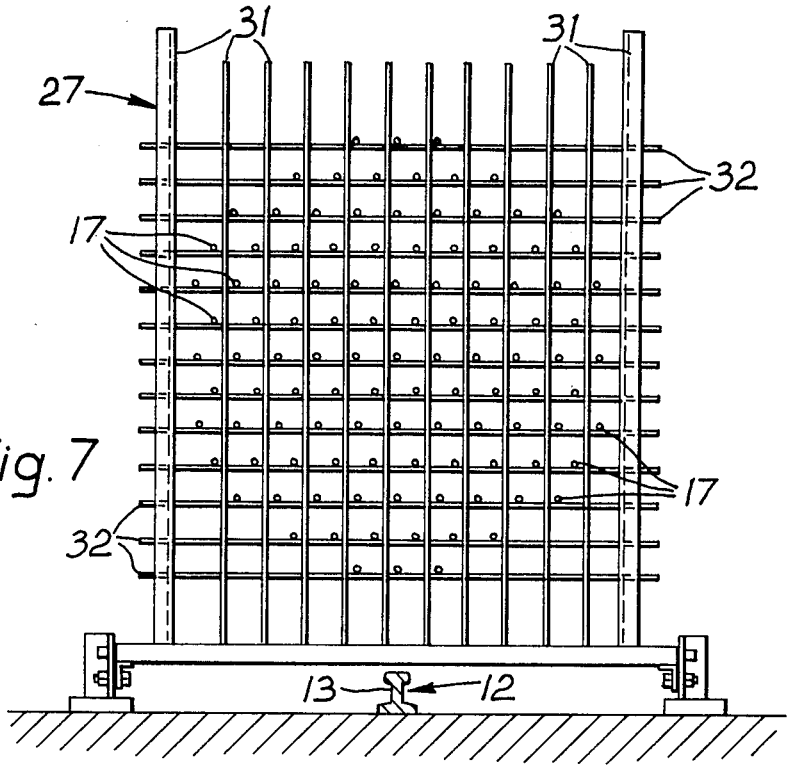
Figure 8:
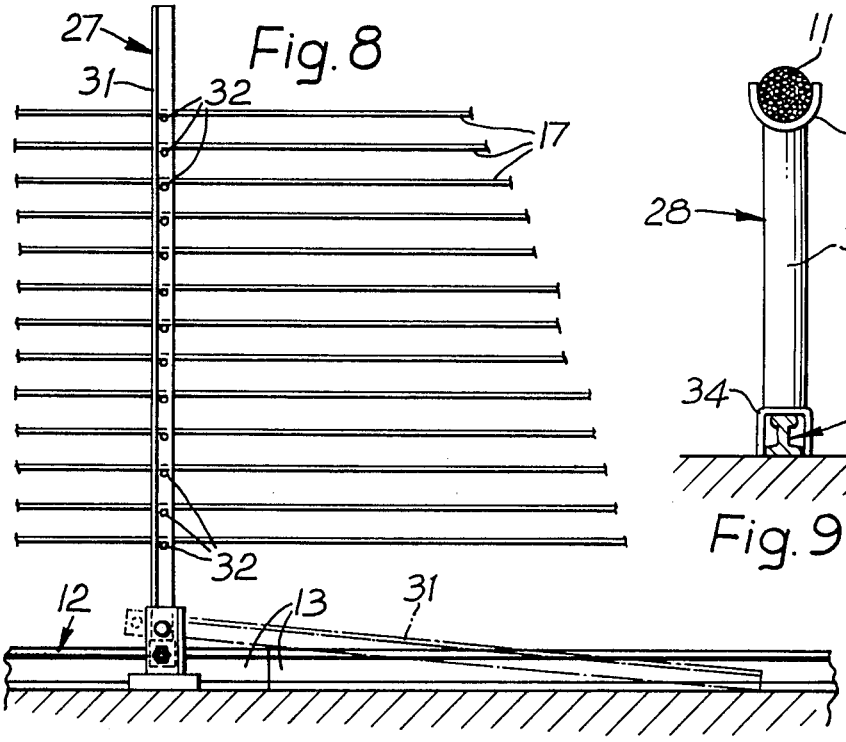
FIG. 8 is a side elevation of FIG. 7.
Figure 9:
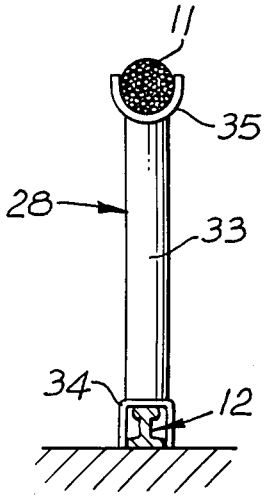
FIG. 9 is an elevation taken from the line IX—IX of FIG. 1 and to the same scale as FIGS. 5, 6 and 7.

As the strand 11 is formed by movement of the trolley 18 along the track 12, the removable wire supports 27 are removed in succession and the removable strand supports 28 are inserted in succession. As can be seen in FIGS. 7 and 8, each removable wire support 27 consists of a collapsible frame with uprights 31 and withdrawable transverse rods 32, while, as can be seen in FIG. 9, each removable strand support 28 consists of a pillar 33 with a base 34 for engaging the track 12 and a part-cylindrical cup 35, and to prevent the strand 11 deforming due to its rotation in this cup, a wrapping of nylon reinforced adhesive tape (not shown) is preferably applied round the strand.

Figure 4:
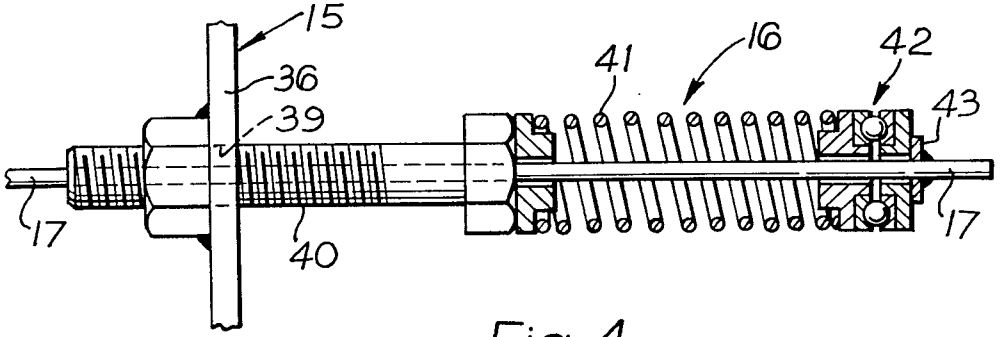
FIG. 4 is a fragmentary part-sectional elevation at the right hand end of the equipment, to an even larger scale.

The anchor frame 15 consists of an apertured plate 36 between uprights 37 with baseplates 38, each aperture 39 being provided, as can be seen in FIG. 4, with a screw adjustable guide tube 40 and a tensioning anchoring device 16 consisting of a compression spring 41 between the guide tube and a thrust bearing 42 which has a thrust washer 43 brazed to the wire 17 to be anchored and tensioned.

Figure 5:
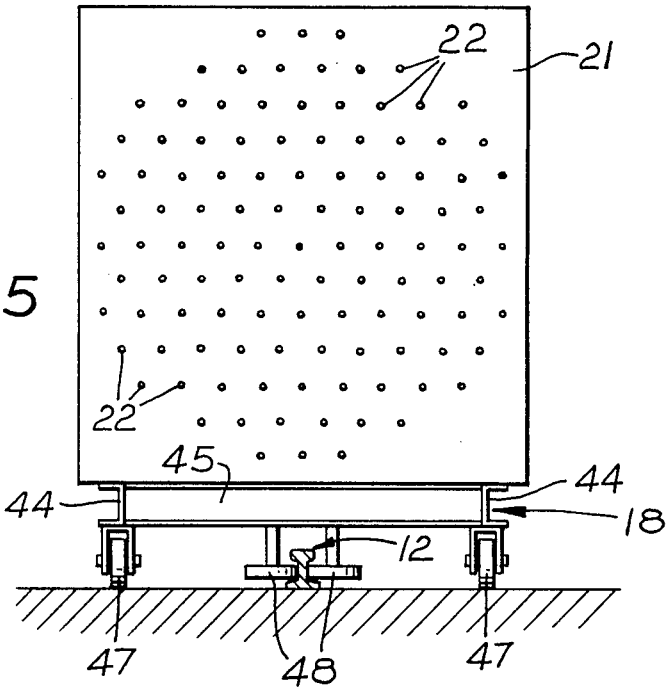
FIGS. 5, 6 and 7 are elevations of intermediate parts of the equipment of FIGS. 1 and 2, taken respectively from the lines V—V, VI—VI and VII—VII of FIG. 1 and to a larger scale.
Figure 6:
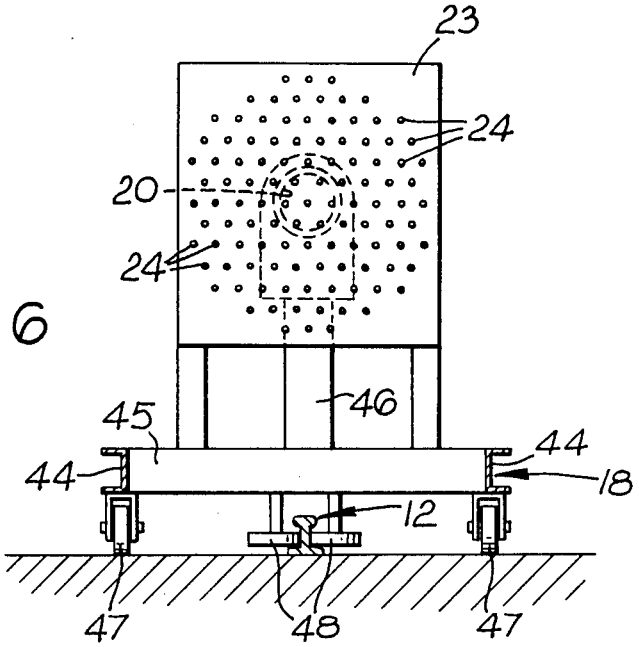

With particular reference to FIGS. 2, 5 and 6, the trolley 18 can be seen to consist of a base frame with longitudinal and transverse members 44, 45 respectively, with the latter carrying the grouper and lay plates 21, 23 and the rotatable die 19 on a bracket 46, and with supporting 47 and guiding wheels 48 for engaging the track 12. The second drive means 26 (for rotating the clamp 14) is a motor 49 at the leading end of the track 12, with gearing 50, 51 for rotating the clamp; and the first drive means 25 (for moving the trolley 18) is a winch 52 at the trailing end of the track, with gearing 53 and a motor 54, which is coupled electronically to the motor 49 of the second drive means in order to obtain the predetermined relationship between rotation of the clamp 14 and movement of the trolley 18. The rotatable clamp is supported by a bracket 55 adapted to be secured to the leading unit 13 of the track 12, along with its drive means 26, and the anchor frame is adapted to be secured to the trailing unit 13 of the track, along with its drive means 25. Any length of strand 11 can be made using a track 12 corresponding length made up by an appropriate number of track units 13. Freedom for the trailing ends of the wires 17 to rotate will generally ensure that no torsional stresses are induced in the wires individually, but for comparatively long lengths (such as are involved in long bridge spans) it may be advantageous to provide additional drive means (not shown) for rotating the trailing ends of the wires.

The combination of tension in the wires 17 and rotation of the leading end 29 of the closed array and free rotation of the trailing ends of the wires results in a helical formation in the wires to maintain a lay along the strand 11. However, the completed strand 11 may be enclosed in a sheath 56 (FIG. 2) only formed of plastics tube which is held by restraints 57 provided on another track 58 (which is also formed of a plurality of modular units 59) adjacent to the strand forming track 12, with a rope 60 from a pulling device (not shown) attached to a pulling eye 61 secured to one end (14 or 30) of the strand 11 for pulling it into the tube.

Figure 10:
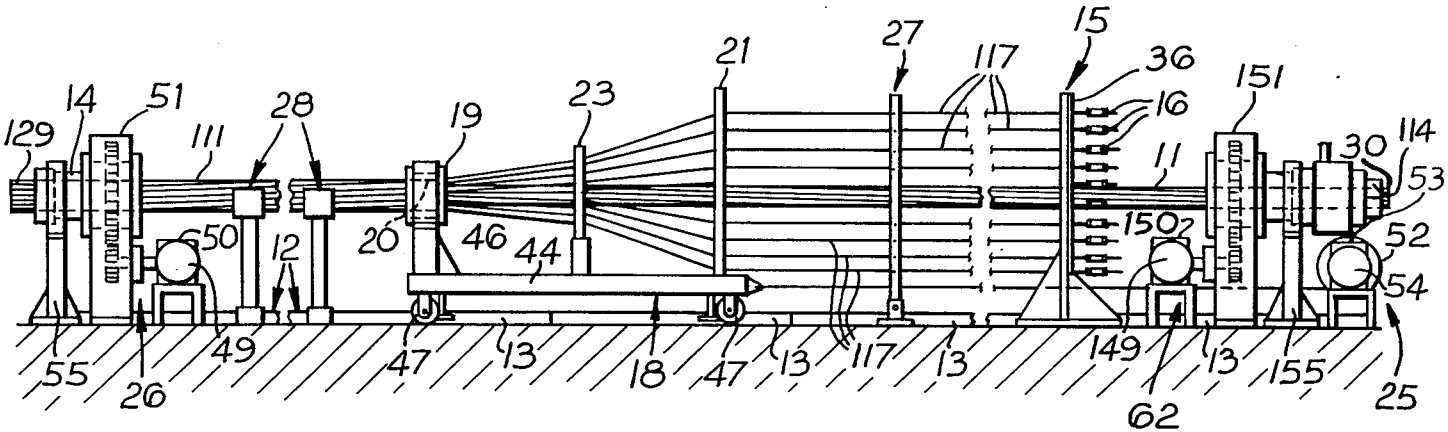
FIG. 10 corresponds to FIG. 1 but shows equipment for multi-operation stranding in accordance with the invention.

The method and equipment are capable of being adapted for multi-operation stranding, as illustrated diagrammatically by FIG. 10 in which like parts of the equipment are designated by the same reference numerals as in FIG. 1. The strand 11, as formed by the method and equipment described with reference to FIGS. 1 and 2, is assembled—as a core strand—at the centre of another multiplicity of wires 117; the leading end 29 of the core strand and the adjacent ends of the wires are secured together (as indicated at 129); the trailing end 30 of the core strand and the adjacent ends of all the wires are secured separately, spaced apart and rotatable; tension is applied to the core strand, e.g., by a hydraulic tensioner (not shown) and to all the wires 117 by the anchorages 16; the wires intermediate the ends are guided into a closed array around the core strand; the aforesaid guiding is wound progressively from the leading end to the trailing end; the leading end 129 of the assembly of core strand 11 and wires 117 is rotated progressively as the aforesaid guiding moves progressively; the trailing ends of the core strand and wires are released (thus releasing the tension applied to the core strand and wires); and the trailing end 30 of the core strand 11 and the adjacent ends of the wires are secured together to form a larger strand 111.

It will be evident that modifications insize are required to the rotatable clamp 14 and the closing die 19, and that a large central aperture is required in each of the plates 21, 23 and 36. The complete length of core strand 11 rotates, and additional drive means 62 are provided at the trailing end of the track 12 for rotating that end of the core strand in synchronisation with the clamp 14 at the leading end of the track, in order to prevent any loss of turn over a long length of core strand. Conveniently, the additional drive means 62 consists of a clamp 114 rotatable in a support bracket 155 and driven by a motor 149 through gearing 150, 151 similar to those of the drive means 26 at the leading end of the track 12 and synchronised therewith.

The lay of the wires 117 is shown as of opposite hand to that of the wires 17. The method and equipment described with reference to FIG. 10 can be used to form a multiple layer strand by repeating the same step with at least one further multiplicity of wires, and the lay of each multiplicity of wires may be of the same or opposite hand to the preceding multiplicity of wires.

What we claim is:

1. A method of making a large wire strand comprising:- assembling a multiplicity of wires side-by-side; securing all the wires permanently together in a predetermined closed array at one, leading end; securing all the wires separately at the other, trailing end, spaced apart and freely rotatable; applying tension to each of the wires; progressively guiding the wires intermediate the ends into the closed array through guiding means; moving the aforesaid guiding means progressively from the leading end to the trailing end; rotating the leading end progressively as the aforesaid guiding means moved progressively and with a predetermined relationship; permanently securing all the wires together at the trailing end of the closed array; and releasing the trailing ends of the wires and the tension applied thereto.

2. A method as in claim 1 further comprising: assembling the strand as a core strand at the centre of another multiplicity of wires; securing one, leading end of the core strand and the adjacent ends of all the wires permanently together in a perdetermined closed array; securing the other, trailing end of the core strand and the adjacent ends of all the wires separately, spaced apart and freely rotatable; applying tension to the core strand and to each of the wires; progressively guiding the wires intermediate the ends into the closed array around the core strand through guiding means; moving the aforesaid guiding means progressively from the leading end to the trailing end; rotating the leading end of the assembly of core strand and wires progressively as the aforesaid guiding means moves progressively and with a predetermined relationship; rotating the trailing end of the core strand synchronously with the leading end; permanently securing the core strand and all the wires together at the trailing end of the closed array to form a larger strand and releasing the trailing ends of the core strand and wires, and the tension applied to the core strand and wires.

3. A method as in claim 2 further comprising the same steps with at least one further multiplicity of wires to form a multiple-layer strand.

4. A method as in claim 1, for making a long lay strand wherein the individual wires are pre-straightened before being assembled side-by-side.

5. A method as in claim 1, wherein the individual wires are of a non-circular cross-section and are pre-twisted before being assembled side-by-side.

6. Equipment for making a large wire strand comprising: an elongate track; a clamp at one, leading end of the track for clamping a predetermined closed array of wires for forming the strand and rotatable about an axis parallel to the track; an anchor frame at the other trailing end of the track having freely rotatable individual tensioning spaced anchorages for the trailing ends of the wires extending parallel to the track; a trolley movable along the track and carrying adjacent the leading end a freely rotatable closing die having an aperture of cross-section corresponding to the closed array of the strand, and adjacent the trailing end a grouper plate having spaced wire guide apertures corresponding to the anchorages on the anchor frame, there also being on the trolley intermediate the closing die and the grouper plate a lay plate having wire guide apertures with spacings intermediate the spacing of the guide apertures in the grouper plate and the closeness in the closing die, for progressively guiding the wires into the closed array; first drive means for moving the trolley along the track from the leading end to the trailing end; second drive means for rotating the clamp at the leading end of the track with a predetermined relationship to movement of the trolley; removable supports for the wires at intervals between the trolley and the anchor frame; and removable supports for the strand at intervals between the rotatable clamp and the trolley.

7. Equipment as in claim 6, wherein the track is formed of a plurality of modular units, and the rotatable clamp and the anchor frame are each adapted to be secured to respective end units of the track.

8. Equipment as in claim 6, wherein for multi-operation stranding additional drive means incorporating tensioning means for the core strand are provided at the trailing end of the track for rotating that end of the core strand while under tension in synchronisation with the second drive means for rotating the clamp at the leading end of the track.

* * * * *